US007671717B2

(12) United States Patent
Zhang et al.

(10) Patent No.: US 7,671,717 B2
(45) Date of Patent: Mar. 2, 2010

(54) UNRECOVERABLE LINE-TYPE TEMPERATURE SENSITIVE DETECTOR HAVING SHORT-CIRCUIT FAULT ALARM FUNCTION

(75) Inventors: Weishe Zhang, Beijing (CN); Gangjin Li, Beijing (CN)

(73) Assignee: Sureland Industrial Fire Safety Limited (CN)

( * ) Notice: Subject to any disclaimer, the term of this patent is extended or adjusted under 35 U.S.C. 154(b) by 190 days.

(21) Appl. No.: 11/900,816

(22) Filed: Sep. 13, 2007

(65) Prior Publication Data

US 2008/0084268 A1 Apr. 10, 2008

(30) Foreign Application Priority Data

Oct. 19, 2006 (CN) ..... 2006 1 0135768

(51) Int. Cl.
*H01H 37/14* (2006.01)
*H05B 1/02* (2006.01)

(52) U.S. Cl. ..... 337/401; 337/416; 374/8; 374/163; 169/60

(58) Field of Classification Search ..... 337/401, 337/416; 374/8, 163, 178; 169/60
See application file for complete search history.

(56) References Cited

U.S. PATENT DOCUMENTS 2,740,874 A * 4/1956 Kelly et al. ..... 338/26
2,750,482 A 6/1956 Peterson
2,764,659 A * 9/1956 Postal ..... 338/26
2,848,587 A * 8/1958 Postal ..... 338/26
2,936,434 A * 5/1960 Postal ..... 338/26
2,941,192 A * 6/1960 Postal ..... 340/577
3,610,808 A * 10/1971 Horwinski ..... 174/115
4,400,680 A * 8/1983 Heline, Jr. ..... 337/415
4,540,972 A * 9/1985 Davis ..... 338/26
4,577,094 A * 3/1986 Mills ..... 219/505
4,607,154 A * 8/1986 Mills ..... 219/505
4,647,710 A * 3/1987 Davis ..... 136/237
4,698,583 A * 10/1987 Sandberg ..... 324/546
4,707,686 A * 11/1987 Greenhalgh ..... 340/596
4,859,989 A * 8/1989 McPherson ..... 340/510
5,143,649 A * 9/1992 Blackledge et al. ..... 252/511
5,185,594 A * 2/1993 DeChurch ..... 340/596
5,541,803 A * 7/1996 Pope et al. ..... 361/103
5,841,617 A * 11/1998 Watkins et al. ..... 361/106

(Continued)

FOREIGN PATENT DOCUMENTS

EP 0 530 012 A1 3/1993

*Primary Examiner*—Anatoly Vortman
(74) *Attorney, Agent, or Firm*—Scully, Scott, Murphy & Presser, P.C.

(57) ABSTRACT

The present invention relates to an unrecoverable line-type temperature sensitive detector having short-circuit fault alarm function, comprises a detecting cable comprising at least two detecting conductors disposed in parallel and a fusible insulation layer, a resistor, and a resistance signal measuring device, wherein the detecting cable further comprises a semiconductor layer, and wherein the semiconductor layer and the fusible insulation layer are disposed between the detecting conductors so as to space the detecting conductors apart. The detector of the present invention may distinguish short-circuit fault from short circuit caused by fire, and thus overcome the disadvantage of not distinguishing short-circuit fault from short-circuit due to fire in the conventional detector. Therefore, the problem of lack of short-circuit fault alarm function in the prior art is resolved. Accordingly, the present invention improves the reliability of unrecoverable line-type temperature sensitive detector.

12 Claims, 2 Drawing Sheets

U.S. PATENT DOCUMENTS 5,862,030 A * 1/1999 Watkins et al. ..... 361/103
6,288,372 B1 * 9/2001 Sandberg et al. ..... 219/544
6,512,444 B1 * 1/2003 Morris et al. ..... 337/401
6,801,117 B2 * 10/2004 Morris et al. ..... 337/401

* cited by examiner

UNRECOVERABLE LINE-TYPE TEMPERATURE SENSITIVE DETECTOR HAVING SHORT-CIRCUIT FAULT ALARM FUNCTION

TECHNICAL FIELD

The present invention generally relates to an unrecoverable line-type temperature sensitive detector, and particularly relates to an unrecoverable line-type temperature sensitive detector having short-circuit fault alarm function.

BACKGROUND OF ART

The conventional unrecoverable line-type temperature sensitive detector is a widely used fire detector. FIG. 1 and FIG. 2 illustrate the conventional unrecoverable line-type temperature sensitive detector and the cross sectional view of its detecting cable. The detecting cable of the detector comprises a sheath 1 having two or more than two (eg. 3 or 4 etc.) detecting conductors 3 twisted with each other therein. The detecting conductor may be elastic conductor, such as shape-memory alloy wire. The detecting conductors are wrapped with a plastic layer 2 with a certain melting point. While the detecting cable is heated, the plastic layer is softened or melted, and the conductors then contact each other under the elastic force of the elastic conductors (or the shape memory alloy wires). Thus, short circuit occurs, thereby performing fire alarm. The advantages of the detector are as follows. That is, the detecting cable may conduct short-circuit alarm when the temperature of any point of the detecting cable reaches a prescribed temperature for alarming. The sensitivity of the detector is irrelevant to the length being heated. Accordingly, the detector is highly sensitive when an article to be protected is overheated in part or the fire is caused from outside. Also, when one conductor of the detector is disconnected, the fault alarm would take place anyway. The disadvantages lie in that the temperature sensitive detector does not have fault alarm function for short circuit, and there is only fire alarm function for short circuit. Therefore, it is hard to distinguish the short-circuit fault from the short-circuit fire alarm signal. Accordingly, an unrecoverable line-type temperature sensitive detector having short-circuit fault alarm function that is capable of distinguishing short-circuit fault from short-circuit caused by fire is desired.

SUMMARY OF THE INVENTION

One object of the invention is to provide an unrecoverable line-type temperature sensitive detector having short-circuit fault alarm function, wherein the detector is capable of distinguishing short-circuit fault and short-circuit fire. Thus, the defect of the unrecoverable line-type temperature sensitive detector of the prior art of lack short-circuit fault alarm function may be overcome, while the reliability of unrecoverable line-type temperature sensitive detector is improved.

The object of the present invention is achieved by an unrecoverable line-type temperature sensitive detector having short-circuit fault alarm function, wherein the line-type temperature sensitive detector comprises a detecting cable, a resistor, and a resistance signal measuring device, wherein the detecting cable comprises at least two detecting conductors disposed in parallel and a fusible insulation layer, characterized in that the detecting cable further comprises a semiconductor layer and that the semiconductor layer and the fusible insulation layer are disposed between the detecting detectors so as to space the detecting conductors apart.

In the present invention, the detecting cable of the unrecoverable line-type temperature sensitive detector further comprises a conducting layer, which is disposed between the semiconductor layer and the fusible insulation layer and in parallel with the semiconductor layer and the fusible insulation layer. The conducting layer is an intermittently conductive layer or a continuously conductive layer, and provides intermittent or continuous conductiveness. The conducting layer may be made of metal wire, non-metal wire, metal sheet, metal foil, a hollow cylindrical metal bush, conductive adhesives, or conductive coatings.

The unrecoverable line-type temperature sensitive detector of the present invention further comprises a sheath wrapped outside the detecting cable.

At least one of the detecting conductors of the unrecoverable line-type temperature sensitive detector of the present invention is an elastic conductor. The elastic conductor may be elastic steel wire or shape-memory alloy wire. The finishing temperature Af of martensite reverse transformation of the shape-memory alloy wire is designed to fall within the range of 20° C. to 140° C.

In the unrecoverable line-type temperature sensitive fire detector of the present invention, the semiconductor layer is made of at least one of PTC, CRT, NTC, conductive rubber, and conductive ceramic. The fusing temperature of the fusible insulation layer is within 40° C. to 180° C. The fusible insulation layer is made of at least one of wax, naphthalene anthracene, stearic acid, rosone, low density polyethylene, high density polyethylene, polypropylene, and polyvinyl chloride.

Comparing with the prior art, the detector of the present invention is to add a semiconductor layer between the two poles of the conductor of the conventional unrecoverable line-type temperature sensitive detector, such that the detected resistances of the detecting cables are different under difference conditions. Therefore, short-circuit fault and short-circuit due to fire can be distinguished. Therefore, the disadvantage of not distinguishing short-circuit fault and short-circuit due to fire is overcome. Also, the unrecoverable line-type temperature sensitive detector of the present invention may provide open circuit fault alarm function etc. so as to provide the unrecoverable line-type temperature sensitive detector with high reliability.

DETAILED DESCRIPTION OF THE PREFERRED EMBODIMENTS

The temperature sensitive detector of the present invention will be described in detail below with reference to accompany drawings.

Figure 1:
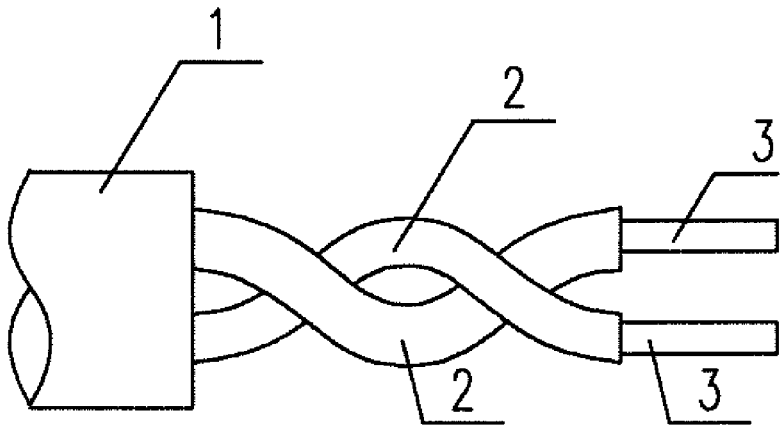
FIG. 1 PRIOR ART
FIG. 1 is a schematic view illustrating a detecting cable of a conventional unrecoverable line-type temperature sensitive detector.
Figure 2:
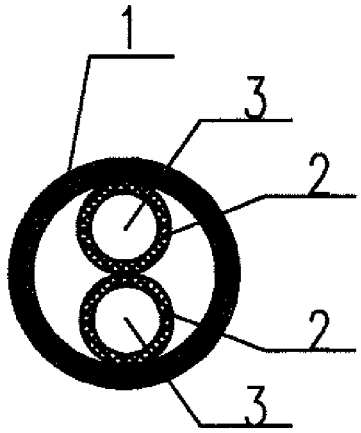
FIG. 2 PRIOR ART
FIG. 2 is a schematic cross sectional view of a detecting cable of a conventional unrecoverable line-type temperature sensitive detector.
Figure 3:
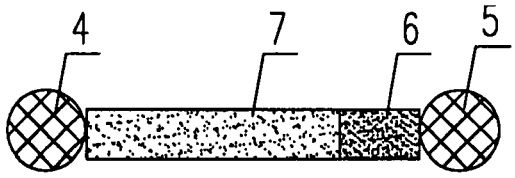
FIG. 3 is a schematic cross sectional view of a detecting cable of an unrecoverable line-type temperature sensitive detector according to an embodiment of the present invention.
Figure 4:
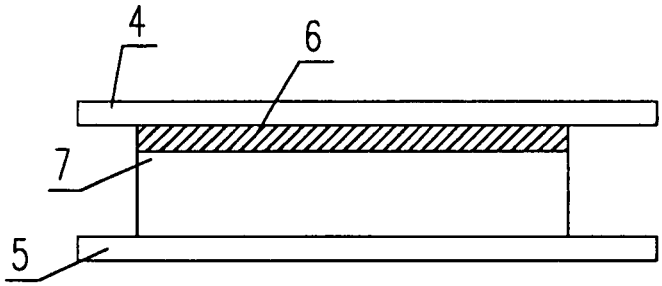
FIG. 4 is a schematic view of a detecting cable of a conventional unrecoverable line-type temperature sensitive detector according to one embodiment of the invention.
Figure 5:
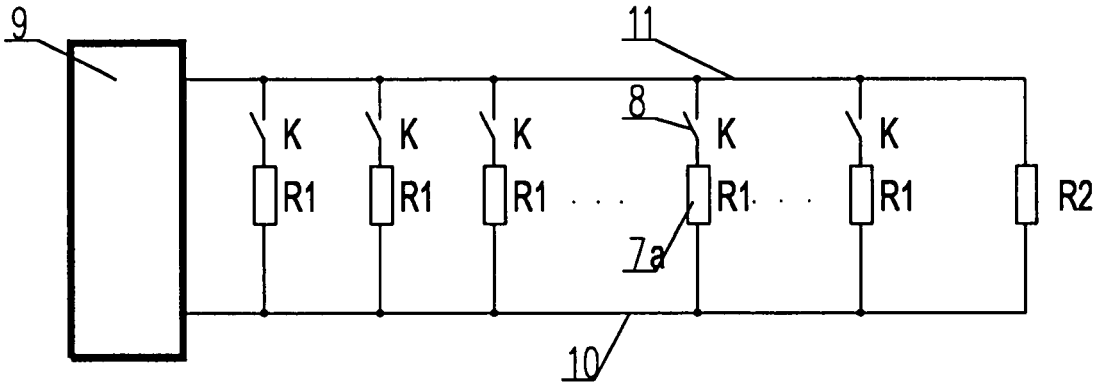
FIG. 5 is a schematic view of an equivalent circuit of an unrecoverable line-type temperature sensitive detector according to the present invention.

The unrecoverable line-type temperature sensitive detector of the present invention comprises a cable, and further comprises a resistor and electrical signal measuring device etc. The detecting cable comprises two detecting conductors, a semiconductor layer disposed between the two detecting conductors, and a fusible insulation layer. FIG. 3 illustrates a line-type temperature sensing member of an unrecoverable line-type fire temperature sensitive detector of the present invention, as shown in the cross sectional view of a part of the detecting cable. FIG. 4 is a cross sectional view of the detecting cable in the longitudinal direction. As shown in FIG. 3 and FIG. 4, in the unrecoverable line-type fire temperature sensitive detector of the present invention, the detecting cable comprises two detecting conductors 4 and 5, a semiconductor layer 7 disposed between the two detecting conductors, and a fusible insulation layer 6. The unrecoverable line-type fire temperature sensitive detector further includes a resistor R2 and electrical signal measuring device 9, as illustrated in FIG. 5. In the present invention, the two detecting conductors 4 and 5 are arranged in parallel with each other, that is, being arranged side by side. The side-by-side arrangement may include coaxial arrangement, arrangement in parallel with each other or arrangement of being twisted together, etc. The semiconductor layer 7 and the fusible insulation layer 6 may be disposed between and in parallel with the two detecting conductors 4 and 5 so as to make the detecting conductors 4 and 5 apart. The fusing temperature of the fusible insulation layer is preferably in the range of 40° C. to 180° C.

FIG. 5 is a schematic view of an equivalent circuit of an unrecoverable line-type temperature sensitive detector according to the present invention. Referring to FIG. 5, the unrecoverable line-type fire temperature sensitive detector of the invention comprises a resistor R2 and an electrical signal measuring device 9. The detecting conductors 4 and 5 are equivalent to the wires 10 and 11, the fusible insulation layer 6 is equivalent to the switch K in the drawing, and the semiconductor layer 7 is equivalent to the resistor R1 in the drawing. The resistor R2 is a terminal resistor of the line-type temperature sensing member and has a resistance of 1 k Ω to 20M Ω. The signal input of the resistor signal detector 9 is connected to one end of the detecting conductor, while the resistor R2 is connected to the other end of the detecting conductor. That is, the electrical signal measuring device 9 is connected to one end of the line-type temperature sensing member, while the resistor R2 is connected to the other end of the line-type temperature sensing member.

Under the condition of normal operation, that is, the condition of no fire and no fault, and the condition that the fusible insulation layer is in good condition and spaces apart the detecting conductors together with the semiconductor layer, the switch K is open. The result of the line-type temperature sensing member measured by the electrical signal measuring device 9 is that the resistance R is the resistance of the resistor R2, that is R=R2.

When open circuit fault occurs, for example, open circuit occurs at a point of the line-type temperature sensing member, such as open circuit occurs in at least one of the two detecting conductors, the fusible insulation layer can still maintain a good condition so as to space the detecting conductors apart together with the semiconductor layer. That is, switch K in FIG. 5 is not closed, but open circuit occurs at a point of the circuit comprised of the wires 10, 11 and the resistor R2. Therefore, the result of the detecting cable measured by the electrical signal measuring device is that the resistance R is infinite, that is, R=∞. At this moment, the electrical signal measuring device 9 sends out an open circuit fault signal to conduct alarm for the open circuit fault.

When the short circuit fault occurs, under the condition of no fire, completely contact conductive occurs at a point between the two detecting conductors of the detecting cable of the detector. Therefore, short circuit fault occurs. That is, short circuit occurs at a point of the circuit comprised of wires 10, 11 and resistor R2 in FIG. 5. At this time, the fusible insulation layer may maintain a good condition. The switch K in FIG. 5 is not closed, and because of short circuit, the resistance R of the result of the line-type temperature sensing member measured by the electrical signal measuring device is approximately 0, that is R≈0. Then, the electrical signal measuring device 9 sends out a short circuit fault signal to conduct short circuit fault alarm.

When fire occurs, that is, when the line-type temperature sensing member of the detector is heated, the temperature rises, and when the temperature reaches the softening temperature range of the fusible insulation layer, the fusible insulation layer is melted, softened or fused. Due to the elastic force, the two detecting conductors eliminate the fusible insulation layer between the two detecting conductors of the part being heated of the detecting cable of the detector. That is, referring to the equivalent circuit as shown in FIG. 5, the fusible insulation layer of the line-type temperature sensing member at the point designated by reference numeral 8 melt, and the switch K at the point designated by reference numeral 8 is closed. At this time, there is still a semiconductor layer between the two detecting conductors of the heated portion of the detector, and this portion is equivalent to the resistor R1 at the point designated by 7*a* in FIG. 5. The resistance R measured by the electrical signal measuring device is determined by the parallel connection of the equivalent resistor R1 and the terminal resistor R2. The measurement of resistance R is smaller than the resistance of the terminal resistor R2, that is 0<R<R2. The resistance signal detector will send out a fire alarm signal according to this measurement.

The line-type temperature sensitive fire detector of the present embodiment may reliably send out different alarm signals according to different results measured by the electrical signal measuring device. Therefore, the reliability of the unrecoverable line-type temperature sensitive fire detector is remarkably improved.

In the present invention, at least one of the two detecting conductors 4 and 5 of the detecting cable may be an elastic conductor, such as elastic steel wire or shape memory alloy wire etc, while another may be metal wire or elastic conductor, such as elastic steel wire or shape memory alloy wire etc. The shape memory alloy wire may be made of nickel-titanium memory alloy, nickel-titanium-copper memory alloy, iron based memory alloy, copper based memory alloy, or other memory material. The value of the finishing temperature Af of the Martensite reverse transformation of the memory ally wire is preferably selected from a range between 20° C. and 140° C.

In the present invention, the detecting cable may comprise two or more detecting conductors. The detecting conductors may be disposed in parallel, for example, being coaxially disposed, being disposed side by side, or being twisted with each other etc. The semiconductor layer and the fusible insulation layer are disposed between the detecting conductors to be in parallel with the detecting conductors. If the detecting conductors are in parallel with each other, or are coaxial with each other, the semiconductor layer and the fusible insulation layer may be disposed between the detecting conductors and be in parallel or coaxially with the detecting conductors. When the detecting conductors are twisted with each other, the detecting conductors may be wrapped with the semiconductor layer and the fusible insulation layer in a conventional manner, and then are twisted with each other. As to the wrapping process, one of the detecting conductors may be wrapped with a semiconductor layer on its outside, and then with a fusible insulation layer. Alternatively, one of the detecting conductors may be wrapped with a fusible insulation layer at first, and then with a semiconductor layer. Of course, the semiconductor layer and the fusible insulation layer may be wrapped on respective detecting conductors.

In the present invention, the semiconductor layer may be at least one of the materials having semiconducting characteristics, such as PTC, CRT, NTC, conductive rubber, conductive ceramics, etc. Other suitable materials may also be used. The thickness of the semiconductor layer is preferably between 0.1 mm to 5 mm. The material of the fusible insulation layer comprises at least one of wax, naphthalene anthracene, stearic acid, rosone, low density polyethylene, high density polyethylene, polypropylene, and polyvinyl chloride, etc. Other suitable material may be used. The thickness of the fusible insulation layer is preferably between 0.1 mm to 2 mm.

Figure 6:
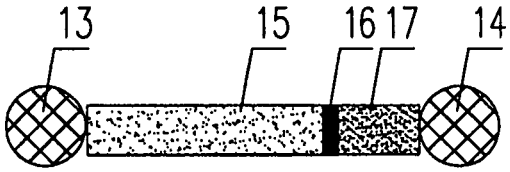
FIG. 6 is a schematic cross sectional view illustrating a detecting cable of an unrecoverable line-type temperature sensitive detector according to another embodiment of the present invention.

FIG. 6 illustrates another embodiment of the unrecoverable line-type temperature sensitive detector having short-circuit alarm function. As shown in FIG. 6, in the present embodiment, the line-type temperature sensing member of the line-type temperature sensitive detector of the present invention comprises two detecting conductors 13 and 14 disposed in parallel, a semiconductor layer 15, a conductive layer 16, and a fusible insulation layer 17. The detector further comprises a resistor R2 (not shown) and an electrical signal measuring device (not shown). The semiconductor layer 15 and the fusible insulation layer 17 are disposed between the two detecting conductors 13 and 14 to be in parallel with the two detecting conductors 13 and 14, thereby spacing the detecting conductors apart. The conductive layer 16 is disposed between the semiconductor layer 15 and the fusible insulation layer 17 to be in parallel with the semiconductor layer 15 and the fusible insulation layer 17, thereby spacing the semiconductor layer 15 and the fusible insulation layer 17 apart.

According to the present embodiment, apart from the above-mentioned operation process, since the conductive layer 16 is disposed between the semiconductor layer 15 and the fusible insulation layer 17 to be parallel with the semiconductor layer 15 and the fusible insulation layer 17, the difference between the measured value R for fire alarm measured by the electrical signal measuring device and the measured value R=R2 in normal operation is increased, thereby providing more accurate fire alarm.

In the embodiment, the conductive layer 16 may be intermittent or continuous, that is, the conductive layer may be intermittently conductive or continuously conductive. The conductive layer 16 is disposed between and in parallel with the semiconductor layer 15 and the fusible insulation layer 17. The conductive layer may be arranged by being twisted with each other, being in parallel with each other, or being coaxial with each other etc. Other known method may also be used.

The conductive layer may be made of metal wire, non-metal wire, metal sheet, metal foil, hollow cylindrical metal bushing, conductive adhesives or coating etc.

The intermittently conductive layer may be made of prefabricated metal wire, non-metal wire, metal sheet, metal foil, hollow cylindrical metal bushing etc. Alternatively, the intermittent conductiveness of the intermittent conductive layer may be achieved by processing a continuous conductive material physically (for example, by mechanical cutting) or in a chemical method after the continuous conductive layer being applied. In case the conductive layer is made of conductive adhesive or coating, the intermittently conductive layer may be formed by intermittently applying, spraying or immersing the conductive adhesive or coating outside the semiconductor layer or the fusible insulation layer so as to directly form a intermittently conductive strip/layer in the longitudinal direction. Alternatively, the intermittent conductiveness may be achieved physically (for example mechanical cutting) or in a chemical method after the continuous conductive paint or coating strip/layer is applied. The conductive length of each section of the intermittently conductive layer is preferably 0.05 m, and the distance between the conductive sections (i.e. the length of nonconductive section) is preferably 0.1 mm to 10 mm.

As mentioned above, the two detecting conductors may be disposed in parallel, such as being disposed coaxially, being disposed side by side, or being twisted with each other etc. The semiconductor layer and the fusible insulation layer may be disposed between and in parallel with the detecting conductors. Similar as described above, the conductive layer 16 may be disposed in parallel between the semiconductor layer and the fusible insulation layer. In case the detecting conductors are twisted with each other, the semiconductor layer, conductive layer, and the fusible insulation layer may be wrapped on a detecting conductor. Alternatively, they can be wrapped on two different detecting conductors. For example, one of the detecting conductors is wrapped with a semiconductor layer and a conductive layer, while the other detecting conductor is wrapped with a fusible insulation layer. Or, one of the detecting conductors is wrapped with a semiconductor layer, while the other detecting conductor is wrapped with a conductive layer and a fusible insulation layer etc. In case the detecting conductors are disposed in parallel or coaxially, similar as described above, the semiconductor layer, the conductive layer and the fusible insulation layer may be disposed between the detecting conductors.

The unrecoverable line-type temperature sensitive detector having short-circuit alarm function according to the present invention may have a sheath outside the line-type temperature sensitive fire detecting cable for protection and insulation. For example, a sheath may be provided on the detecting conductors, semiconductor layer, and the fusible insulation layer. Alternatively, a sheath may be provided on the detecting conductors, the semiconductor layer, the conductive layer and the fusible insulation layer.

Although the present invention has been described with reference to the accompany drawings and embodiments, it should be understand that the variation or amendment to the invention may be made by those skilled in the art without departing from the spirit and scope of the present invention. For instance, although only the condition of two detecting conductors has been discussed in the above embodiments, it is obvious for those skilled in the art to use more than two detecting conductors when necessary. For example, a line-type temperature sensing member may comprise three detecting conductors. In addition, a semiconductor layer, a conductive layer, and fusible insulation layer may be arranged in parallel with at least two detecting conductors, and may be disposed between the at least two detecting conductors to space the at least two detecting conductors apart, etc.

The invention claimed is:

1. An unrecoverable line-type temperature sensitive detector having short-circuit fault alarm function, comprising a detecting cable, a resistor and a resistance signal measuring device, said detecting cable comprising at least two detecting conductors disposed in parallel with each other and a fusible insulation layer, wherein the detecting cable further comprises a semiconductor layer, and the semiconductor layer and the fusible insulation layer are disposed between the detecting conductors to space the detecting conductors apart.

2. The unrecoverable line-type temperature sensitive detector according to claim 1, further comprising a sheath wrapped outside the detecting cable.

3. The unrecoverable line-type temperature sensitive detector according to claim 1, wherein the detecting cable further comprises a conductive layer, which is disposed between the semiconductor layer and the fusible insulation layer and in parallel with the semiconductor layer and the fusible insulation layer.

4. The unrecoverable line-type temperature sensitive detector according to claim 3, wherein the conductive layer is an intermittently conductive layer or a continuously conductive layer so as to provide an intermittent or a continuous conductiveness.

5. The unrecoverable line-type temperature sensitive detector according to claim 4, further comprising a sheath wrapped outside the detecting cable.

6. The unrecoverable line-type temperature sensitive detector according to claim 4, wherein the conductive layer is made of at least one of metal wire, non-metal wire, metal sheet, metal foil, hollow cylindrical metal bush, conductive adhesive, and conductive coating.

7. The unrecoverable line-type temperature sensitive detector according to any of claims 1 to 6, wherein least one of the detecting conductors is an elastic conductor.

8. The unrecoverable line-type temperature sensitive detector according to claim 7, wherein the elastic conductor is an elastic steel wire or a shape memory alloy wire.

9. The unrecoverable line-type temperature sensitive detector according to claim 8, wherein the finishing temperature Af of the Martensite reverse transformation of the shape memory alloy wire is in a range between 20° C. and 140° C.

10. The unrecoverable line-type temperature sensitive detector according to claim 7, wherein the semiconductor layer is made of at least one of PTC, CRT, NTC, conductive rubber, and conductive ceramic.

11. The unrecoverable line-type temperature sensitive detector according to claim 7, wherein the fusing temperature of the fusible insulation layer is in a range between 40° C. to 180° C.

12. The unrecoverable line-type temperature sensitive detector according to claim 11, wherein the fusible insulation layer is made of at least one of wax, naphthalene anthracene, stearic acid, rosone, low density polyethylene, high density polyethylene, polypropylene, and polyvinyl chloride.

* * * * *